US006454493B1

(12) United States Patent
Lohbeck

(10) Patent No.: US 6,454,493 B1
(45) Date of Patent: Sep. 24, 2002

(54) METHOD FOR TRANSPORTING AND INSTALLING AN EXPANDABLE STEEL TUBULAR

(75) Inventor: Wilhelmus Christianus Maria Lohbeck, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/606,134

(22) Filed: Jun. 28, 2000

(51) Int. Cl.[7] ..... E21B 43/10

(52) U.S. Cl. ..... 405/184.2; 138/118.1; 138/119; 166/371; 166/380; 166/77.1; 29/437; 29/507; 29/523; 29/522.1

(58) Field of Search ..... 29/235, 446, 449, 29/450, 451, 452, 437, 507, 523, 522.1; 138/118, 118.1, 98, 123–127, 119; 166/207, 214, 384, 77.1, 77.2, 371, 380, 277; 405/184.2, 184.3

(56) References Cited

U.S. PATENT DOCUMENTS 3,104,703 A * 9/1963 Rike et al.
3,811,633 A 5/1974 Cummings et al.
3,934,660 A 1/1976 Nelson
3,939,875 A * 2/1976 Osborn et al.
4,622,196 A * 11/1986 Wood
4,715,443 A * 12/1987 Gidley
4,770,562 A * 9/1988 Muller et al.
4,867,921 A * 9/1989 Steketee, Jr.
5,366,012 A * 11/1994 Lohbeck
5,667,011 A * 9/1997 Gill et al.
5,794,702 A * 8/1998 Nobileau
6,012,522 A * 1/2000 Donnelly et al.
6,089,276 A * 7/2000 Miyazaki et al.
6,146,491 A * 11/2000 Wood et al.
6,354,373 B1 * 3/2002 Vercaemer et al.

FOREIGN PATENT DOCUMENTS

| | | |
|---|---|---|
| WO | 93/25800 | 12/1993 |
| WO | 98/00626 | 1/1998 |
| WO | 98/07957 | 2/1998 |

* cited by examiner

*Primary Examiner*—David P. Bryant
*Assistant Examiner*—Eric Compton

(57) ABSTRACT

A method is provided for expanding an expandable steel tubular including the steps of: flattening the unexpanded tubular; transporting the flattened unexpanded tubular to a location at or near the site where the tubular is to be installed; unflattening the tubular before positioning the tubular at said site; and expanding the tubular along at least a substantial part of its length before or after the tubular has been positioned at said site.

14 Claims, 3 Drawing Sheets

METHOD FOR TRANSPORTING AND INSTALLING AN EXPANDABLE STEEL TUBULAR

BACKGROUND OF THE INVENTION

The invention relates to a method for transporting and installing an expandable steel tubular.

An expandable slotted steel tubular is known from European patent specification EP 0643795 and an expandable unslotted or solid tubular made of a formable steel grade is known from International patent application, publication No. WO 98/00626.

These prior art references disclose that an essentially conical mandrel may be used to plastically expand the tubular such that the internal and outer diameter of the tubular are increased.

A general problem with these and other known steel tubulars is that they are voluminous and fragile elongate pieces of equipment which are difficult to transport from a manufacturing plant to a use site, which results in high transportation and storage costs. Furthermore, a large amount of connectors is required to make up a tubular string.

It is an object of the present invention to provide a method, which allows a cheap and efficient transport of expandable steel tubulars from a manufacturing plant to an industrial site where the tubular is to be expanded and used.

It is observed that it is known from U.S. Pat. No. 3,811,633 to make an extendable tubular structure, which is collapsibly folded when wound onto a spool for storage. The known structure thereto comprises a pair of parallel elongated ribbons which are interconnected by profiled side walls which are folded flat during storage and which are folded out when the tubular is unwound such that a generally square tubular is formed which is neither cylindrical nor expandable.

It is observed that is also known in the art to roll hoses that are used e.g. for domestic use or for fire fighting in a flat shape around a reeling drum or in a coil. However, such hoses are made of plastic fabric and/or elastomeric materials which are by their nature already flexible so that flattening can be easily achieved, whereas flattening of steel tubulars for industrial use has not yet been applied.

Therefore, when used in this specification, the term steel tubular excludes an essentially flexible non-metallic hose which is not installed, but used in a movable mode e.g. for domestic, gardening or fire fighting applications.

It is observed that U.S. Pat. No. 3,934,660 discloses a method for in-situ forming a well casing wherein a resilient metal strip is folded into a scrolled shape and maintained in that shape by explosive bolts whereupon the folded casing is inserted into the well. The casing is then installed by releasing the bolts such that the casing unscrolls and presses itself against the borehole wall.

The method for transporting and installing a steel tubular in accordance with the pre-amble of claim 1 is known from International patent application WO98/07957. In the known method a tubular steel casing is reeled in a collapsed flattened configuration around a reeling drum. The flattened casing is after unreeling from the drum and before inserting the casing into a borehole further folded into a kidney shape to permit movement of the flattened casing through the borehole. When the folded and flattened kidney-shaped casing has arrived at the downhole location where it is to be installed the kidney-shaped casing is inflated into a cylindrical shape whereupon an inflatable packer may be inserted into the casing to plastically deform a portion of the upper part of the casing into tight gripping and sealing engagement with an already installed casing section.

The folding of the flattened casing into a kidney shape involves high stresses and if the casing is moved through a curved section of the borehole the casing is bent even further which can easily lead to buckling or rupture of the casing.

The present invention aims to overcome the problems associated with the prior art installation techniques and to provide an installation method which neither requires the folding of the casing into a kidney-shape during installation nor requires the use of a metal strip which unscrolls itself against the borehole or other cavity wall.

SUMMARY OF THE INVENTION

The method according to the invention is characterized in that before the tubular is positioned at the site where it is to be installed the tubular is first unflattened into a substantially cylindrical or oval shape and that the thus already unflattened tubular is radially expanded along at least a substantial part of its length after the tubular has been positioned at the site where the tubular is to be installed.

It is observed that surprisingly it has been found that the plastic properties that are required to make steel tubulars sufficiently flexible to make them expandable can also be used to flatten the unexpanded tubular during transport and to unflatten the tubular at the site where it is to be used.

It will be understood that the transport of flattened unexpanded steel tubulars significantly reduces the volume of the transported tubulars and associated transport costs.

Preferably the flattened unexpanded tubular is wound around a reeling drum before transporting the tubular to the site where it is to be used and reeled from the reeling drum before unflattening the tubular.

Suitably the tubular is made of a formable steel grade and/or comprises a predetermined pattern of openings or weak spots which open up and are deformed during the expansion process.

Preferably said pattern is such that at opposite sides along the circumference of the tubular a longitudinal or helical series of openings or weak spots is arranged which series define a longitudinal or helical band where the tubular wall is folded during the step of flattering the unexpanded tubular.

A suitable tubular of the above kind comprises a staggered pattern of elongate slots or elongate weak areas which open up into a substantially prismatic shape during the expansion process. Such an expandable slotted tubular is disclosed in European patent specification EP 0643795. It is observed that when used in this specification the term flattening of a tubular means that the tubular is deformed into a truly flat or substantially oval shape and that the term unflattening of a tubular means that the roundness of the tubular is increased, so that the tubular obtains a substantially cylindrical or oval shape.

Experiments have shown that an expandable steel tubular which is equipped with a staggered pattern of partially overlapping axial slots can be flattened such that the opposite tubular walls touch each other when the flattened unexpanded tubular is wound around a reeling drum and that subsequently the unexpanded tubular can be unflattened into a nearly cylindrical shape.

Since if the unflattened tubular is inserted into a cavity, such as a borehole or corroded pipe, that cavity is oversized when compared with the outer diameter of the unexpanded tubular there is no requirement to bring the unexpanded tubular into a perfectly cylindrical shape. Also the expansion of the tubular with e.g. a conical expansion mandrel does not require the use of a perfectly cylindrical unexpanded tubular as a starting point, whereas the conical mandrel will still be able to expand the tubular into a substantially cylindrical shape.

Expandable solid tubulars made of a formable steel grade preferably are flattened into a substantially oval shape when they are reeled around a reeling drum, whereas the roundness of the unexpanded tubular is increased before the expansion process. Again expansion of the tubular using an expansion cone still resulted in a substantially cylindrical expanded tubular.

Thus it will be understood that flattening of expandable tubulars significantly reduces transport and storage cost since the storage of tubulars which are both unexpanded and flattened has synergetic effects, whereas the temporary flattening during transport and storage has no effect on the roundness of the expanded tubular.

It is preferred that the tubular is unflattened by moving the flattened unexpanded tubular in a longitudinal direction through a funnel arrangement which comprises a tubular opening formed by series of rollers and/or a tubular guide funnel, which opening has an inner diameter which is substantially equal to the outer diameter of the unexpanded unflattened tubular.

The method according to the present invention is very suitable for use with expandable tubulars which are made of a formable steel grade and are in use inserted into an underground wellbore or corroded pipe and then expanded to form a steel lining in the wellbore or existing pipe.

When used in this specification the term formable steel grade means that the steel is subject to substantial strain hardening as a result of the expansion process. Preferably the tubular is made of a high strength steel grade with formability and having a yield strength-tensile strength ratio which is lower than 0.8 and a yield strength of at least 275 MPa. Suitable steels of this kind are dual phase (DP) high strength, low alloy (HSLA) steels having a strain hardening exponent n of at least 0.6, and preferably at least 0.16.

If the tubular is to be inserted into a tubular cavity, such as a wellbore or subsurface or above-ground pipeline, and to be moved in a centralised position through the cavity then the tubular may be equipped with a series of bow spring centralisers which are at least one end slidably secured to the outer surface of the tubular and which centralisers are also flattened when the unexpanded tubular is flattened and which deform into a low shape when the tubular is unflattened.

If the tubular is slotted and to be used in an area where an impermeable tubular wall is required then an impermeable wrapping or elastomeric sleeve may be arranged around the tubular to provide a fluid seal.

Suitably the tubular is expanded by an expandable expansion mandrel which is inserted into the unexpanded unflattened tubular in its retracted shape and subsequently expanded and moved in an axial direction through the tubular during the tube expansion process.

BRIEF DESCRIPTION OF THE DRAWING

The invention will now be described in more detail and by way of example with reference to the accompanying drawings in which.

DETAILED DESCRIPTION OF PREFERRED EMBODIMENTS

Figure 1:
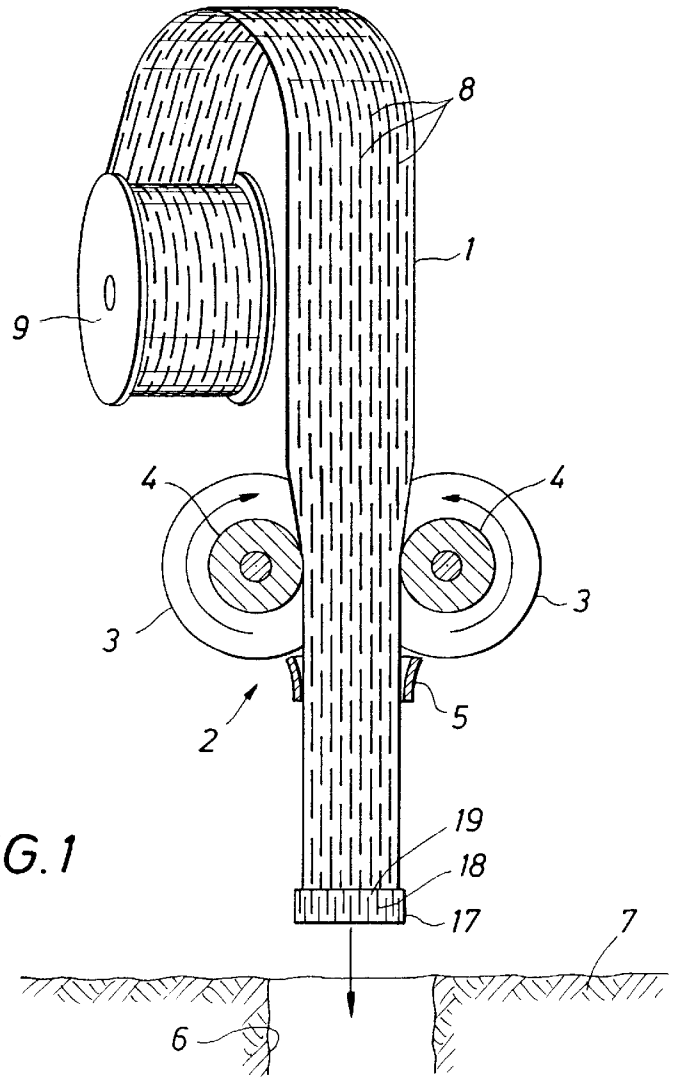
FIG. 1 is a three-dimensional view of an expandable slotted tubular of which the upper end is flattened and which is moved through a funnel arrangement which brings the tubular into the substantially cylindrical shape shown at the bottom.

Preferring now to FIG. 1 there is shown an unexpanded expandable slotted tube 1 of which the upper end has been flattened and the lower end has been brought into a substantially cylindrical shape by a funnel arrangement 2.

The funnel arrangement 2 comprises a pair of guide wheels 3 which have a semi-circular outer surface 4 which push the tubular 1 into a substantially cylindrical shape and a guide ring 5 having an inner surface of a low friction material, which ring 5 serves to guide the tubular 1 into the wellbore 6 of a borehole traversing a subsurface earth formation 7.

The tubular 1 comprises a regular pattern of at least partly overlapping staggered slots 8 which have been cut through or partly through the wall of the tubular 1 at a manufacturing plant. At the manufacturing plant the tubular has been flattened by pulling the tubular 1 through a pair of rollers (not shown) which have a substantially flat outer surface and which are spaced apart at a distance which is equal to about three times the wall thickness of the tubular 1. At the manufacturing plant the flattened tubular 1 is wound around a reeling drum 9 which is subsequently transported to the well site where the tubular 1 is again wound from the reeling drum 9, and subsequently unflattened in the guide funnel arrangement 2 and lowered into the underground wellbore 6.

To allow a smooth decent of the unexpanded tubular 1 into the wellbore 6 an end ring 17 or nose section may be secured to the lower end of the unflattened tubular 1. Preferably the end ring 17 or nose section is made of a relatively soft material, such as aluminium, plastic, or cement which easily deforms and/or breaks during the expansion process and which can, if necessary, be removed easily thereafter by a drilling or milling tool.

The upper end of the end ring 17 may be provided with a series of parallel axial slots 18 (not shown) which correspond to the slots 8 at the lower end of the tubular 1. The fingers 19 formed between the slots 18 and 8 at the upper end of the end ring 17 and the lower end of the lower end of the tubular 1 may be connected to each other by screws, or by bonding, welding or brazing. The fingers 19 at the upper end of the end ring 17 allow full expansion of the lower end of the slotted tubular 1 during the expansion process.

If also the upper end of the tubular 1 is to be lowered into the wellbore 7 a so-called ball grab tool (not shown) may be inserted into the upper end of the unflattened tubular 1. The ball grab tool is to be provided with a sleeve which surrounds the upper end of the tubular 1 to prevent expansion of the upper end of the tubular 1 when the ball grab tool is expanded to grip the upper end of the tubular.

The ball grab tool may be suspended at the lower end of a hoisting cable or tubing string which is lowered into the wellbore 7 until the tubular 1 has arrived at the location in the wellbore 7 where it is to be used. Depending on the circumstances the ball grab tool may be removed before, during or at the end of the tube expansion process which is described with reference to FIG. 2.

Figure 2:
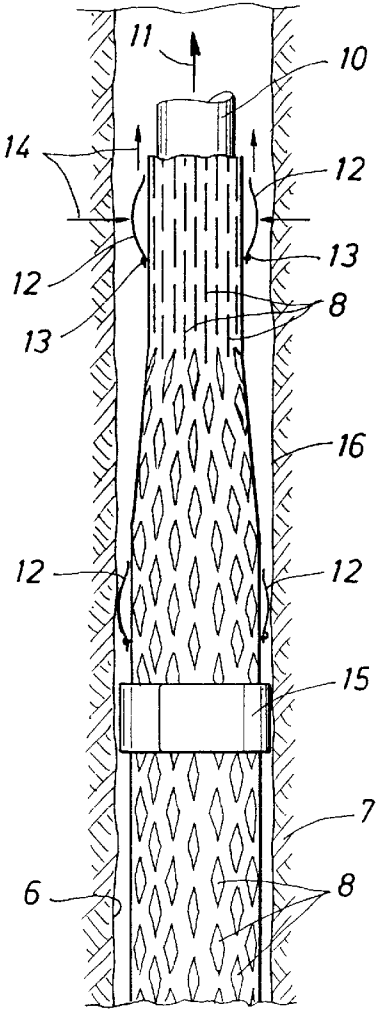
FIG. 2 shows the tubular of FIG. 1 during the expansion process wherein a conical expansion mandrel is pulled through the tubular.

Referring now to FIG. 2 there is shown the tubular 1 of FIG. 1 after it has been lowered into the underground borehole 6 and while the tubular 1 is being expanded by pulling an expansion mandrel (not shown) by means of a pulling pipe 10 in upward direction through the tubular 1 as illustrated by arrow 11.

As a result of the expansion process the staggered elongate longitudinal slots 8 open up into a substantially prismatic shape as shown at the bottom of FIG. 2.

In order to centralise the unexpanded tubular 1 in the wellbore 6 during its descent and expansion a series of bow spring centralisers 12 is provided at regular spacing on the outer surface of the tubular 1.

Each centraliser 12 is fixed at its lower end to the tubular 1 by means of a bolt or rivet 13 and is at its upper end slidably secured to the tubular 1 by means of a bolt (not shown) which is allowed to slide through a longitudinal groove (not shown) in the centraliser 12 so that the centralisers are allowed to be flattened as a result of the expansion process as illustrated by the arrows 14 and as illustrated in the middle of FIG. 2.

At a location where influx of fluids from the surrounding earth formation 7 into the wellbore 6 is to be prevented an impermeable wrapping 15 is arranged around the tubular 1. During the expansion process diameter of the wrapping 15 is increased and the wrapping 15 is squeezed and firmly fixed between the expanded tubular 1 and the borehole wall 16.

The wrapping 15 may consist of a fabric which is impermeable or made impermeable after the expansion process by impregnating the fabric with a resin that cures downhole and which fabric is scrolled around the tubular 1. Alternatively the wrapping 15 may consist of a rubber or elastomeric sleeve which is stretched as a result of the expansion process or a scrolled or diaphragm type sheet or plate where the amount of overlap is reduced as a result of the expansion process.

Figure 4:
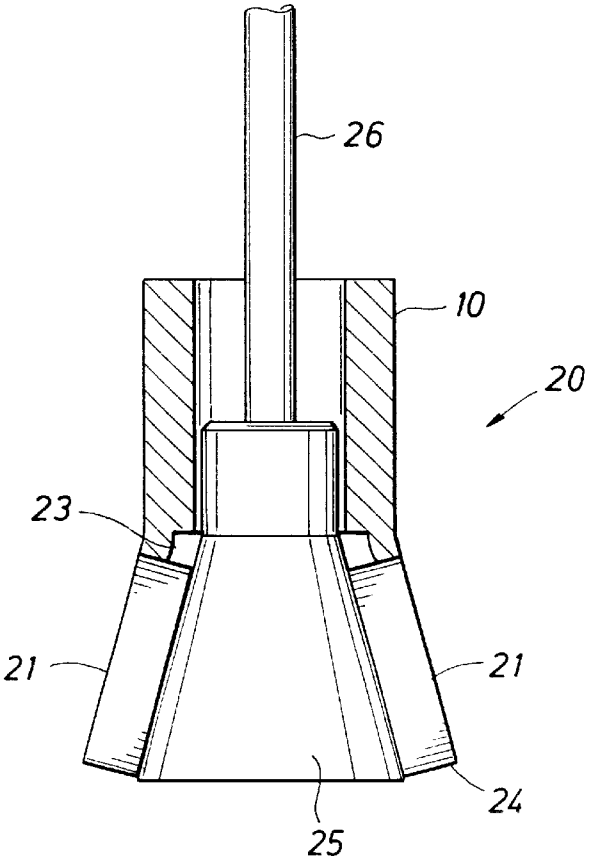
FIG. 4 is a schematic side view of the expanded conical mandrel of FIG. 3 while expanding the tubular of FIG. 2.
Figure 3:
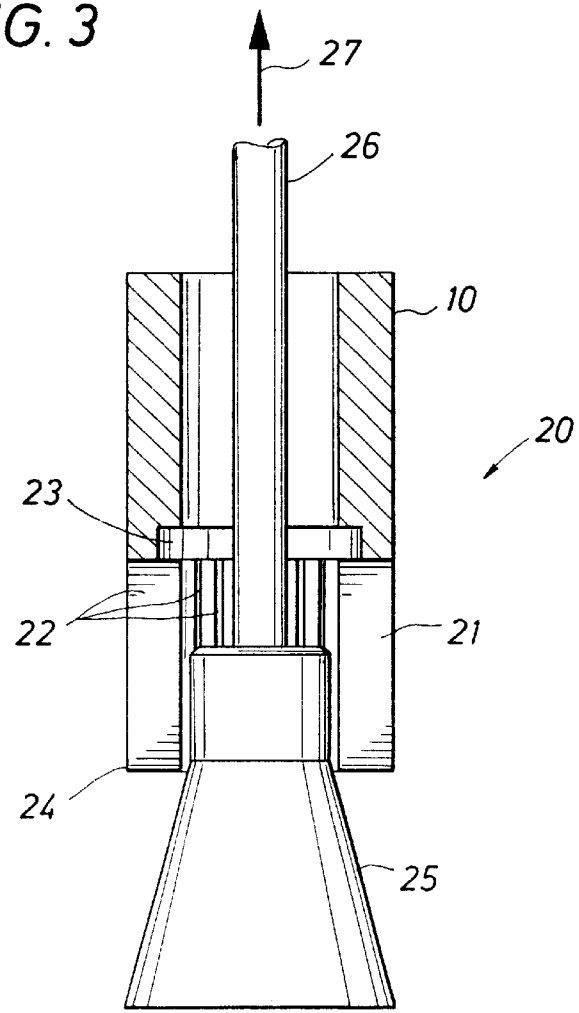
FIG. 3 is a schematic side view of an unexpanded expandable conical mandrel for use in expanding the slotted tubular of FIG. 2.

FIG. 3 and 4 show an expandable expansion mandrel 20 for use in the expansion process illustrated in FIG. 2.

The mandrel 20 is shown in FIG. 3 in its unexpanded shape which allows the mandrel to be lowered through the unexpanded tubular 1 before the expansion process.

The mandrel 20 comprises a series of fingers 21 which are formed at the lower end of the pulling pipe 10 by cutting parallel axial slots 22 at regular distances through the wall of the pulling pipe 10 between the lower end 24 of the pulling pipe 10 and a circumferential groove 23 that has been machined in the inner wall of the pulling pipe 10.

A conical plunger 25 is located at the lower end 24 of the pulling pipe 10. The plunger 25 is suspended from a pulling rod 26 which can be pulled up and down through the interior of the pulling pipe as illustrated by arrow 27.

FIG. 4 shows the expansion mandrel of FIG. 3 in its expanded shape after the conical plunger 25 has been pulled up by means of the pulling rod 26.

The upward motion of the conical plunger 25 has caused the fingers 21 to flex outward wherein the area of reduced pipe wall thickness surrounding the groove 23 where the pipe acts as a hinge.

The pipe wall surrounding the groove 23 is plastically deformed by the upward motion of the conical plunger 25 so that when the plunger 25 is pushed downward through the pulling pipe 10 at the end of the expansion process the fingers 21 can be pushed back plastically when a restriction is passed to their longitudinal orientation as is shown in FIG. 3.

Figure 5:
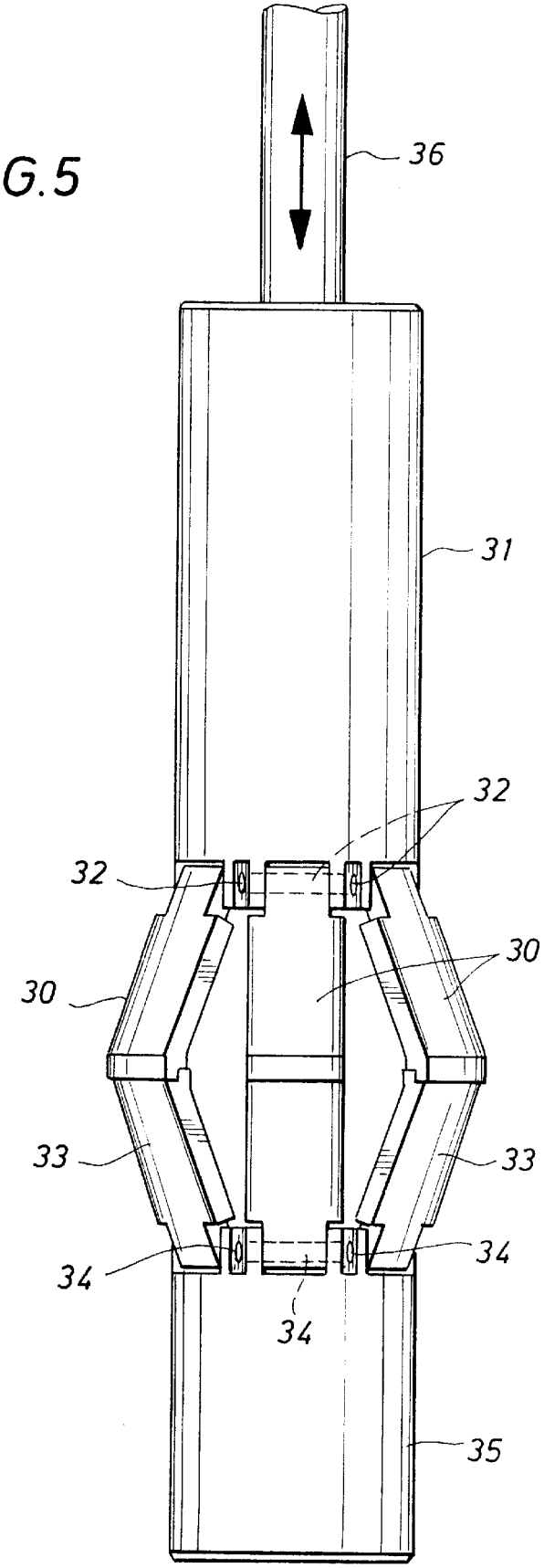
FIG. 5 is a three-dimensional view of an alternative embodiment of an expandable mandrel for use in the method according to the invention.

FIG. 5 shows an alternative configuration of an expansion mandrel wherein a series of arms 30 are secured to the lower end of a pulling pipe 31 by means of hinges 32.

A second series of arms 33 is secured by means of a series of hinges 34 to an end ring 35.

The arms 30 and 33 are slidably arranged around an internal cone 36.

The arms 32 and 33 can be pushed out into the expanded position shown by pulling the end ring 35 and cone 36 at different speeds towards the lower end of the pulling pipe 31 by pulling a rod 36 up through the pipe 31.

The arms 32 and 33 can be retracted into a stretched configuration by pushing the rod 36 down through the pulling pipe 31 which induces the free ends of the arms 30 and 30 to slide back towards the tips of the cone 36.

The expandable and retractable expansion mandrels shown in FIGS. 3, 4 and 5 are particularly suitable for expanding slotted tubulars 1 which have been flattened during transport and storage since the unflattened tubular 1 does not need to be perfectly round to lower the mandrel through the unexpanded tubular and sufficient clearance is left to allow the unexpanded mandrel to be lowered to the bottom of the unexpanded tubular.

Experiments have shown that the process of flattening a tubular during transport and storage and subsequent unflattening and expansion of the tubular cannot only be used with slotted tubulars as shown in FIGS. 1 and 2 but also with unslotted tubulars, provided that with unslotted tubulars the flattening is preferably limited such that the tubulars have a substantially oval shape when it is reeled around a reeling drum and flattened to about six times the wall thickness of the tubular.

I claim:

1. A method for transporting and installing a steel tubular into a underground borehole or other cavity, the method comprising the steps of:

flattening the tubular;

transporting the flattened tubular to a site where the tubular is to be installed into the underground borehole or other cavity;

unflattening the tubular, thereby increasing the tubular roundness;

positioning the unflattened tubular into the underground borehole or other cavity; and expanding the unflattened tubular alongside the inner wall of the underground borehole or other cavity at least a substantial part of its length after the unflattened tubular has been positioned in order to install the tubular in the underground borehole or other cavity at said site.

2. The method of claim 1, wherein the flattened unexpanded tubular is wound around a reeling drum before transporting the tubular to said site and reeled from the reeling drum before unflattening the tubular.

3. The method of claim 1, wherein the unexpanded tubular comprises a predetermined pattern of openings or weak spots which open up and are deformed during the expansion process.

4. The method of claim 3, wherein said pattern is such that at opposite sides along the circumference of the tubular a longitudinal or helical series of openings or weak spots is arranged which series define a longitudinal or helical band where the tubular wall is folded during the step of flattening the unexpanded tubular.

5. The method of claim 3, wherein the tubular comprises a staggered pattern of elongate slots or elongate weak areas which open up into a substantially prismatic shape during the expansion process.

6. The method of claim 1, wherein the tubular is unflattened by moving the tubular into a funnel arrangement.

7. The method of claim 6, wherein the funnel arrangement comprises a tubular opening formed by a series of rollers and/or a tubular guide funnel, which opening has an inner diameter which is substantially equal to the outer diameter of the unexpanded unflattened tubular.

8. The method of claim 1, wherein the tubular is an oilfield tubular and is made of a formable steel grade.

9. The method of claim 8, wherein the tubular is equipped with a series of bow spring centralisers which are at least one end slidably secured to the outer surface of the tubular and which centralisers are also flattened when the unexpanded tubular is flattened and which deform into a bow shape when the tubular is unflattened.

10. The method of claim 8, wherein the tubular is a slotted tubular for use in an underground borehole and is provided with an impermeable wrapping at locations where an impermeable expanded tubular is required.

11. The method of claim 10, wherein the impermeable wrapping consists of a deformable rubber.

12. The method of claim 10, wherein the tubular is expanded by an expandable expansion mandrel which is inserted into the unexpanded unflattened tubular in its retracted shape and subsequently expanded and moved in an axial direction through the tubular during the expansion process.

13. The method of claim 10, wherein the impermeable wrapping consists of a scrolled sheet of an impermeable fabric material.

14. The method of claim 10, wherein the impermeable wrapping consists of a scrolled sheet of fabric material that is made impermeable in-situ.

* * * * *